US009806406B2

(12) United States Patent
Lee et al.

(10) Patent No.: US 9,806,406 B2
(45) Date of Patent: Oct. 31, 2017

(54) PLASMA ANTENNA

(71) Applicant: Electronics & Telecommunications Research Institute, Daejeon (KR)

(72) Inventors: Kwang Chun Lee, Daejeon (KR); Cheol Ho Kim, Gunpo-si (KR); Gweon Do Jo, Seoul (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/604,398

(22) Filed: Jan. 23, 2015

(65) Prior Publication Data

US 2015/0214608 A1 Jul. 30, 2015

(30) Foreign Application Priority Data

Jan. 24, 2014 (KR) ..... 10-2014-0008783

(51) Int. Cl.
*H01Q 1/26* (2006.01)
*H01Q 1/36* (2006.01)

(52) U.S. Cl.
CPC ..... *H01Q 1/366* (2013.01)

(58) Field of Classification Search
CPC ..... H01Q 1/366
See application file for complete search history.

(56) References Cited

U.S. PATENT DOCUMENTS 5,386,215 A * 1/1995 Brown ..... H01Q 1/38 343/792.5
6,825,814 B2 11/2004 Hayes
7,324,059 B2 1/2008 Lee et al.
7,545,841 B2 * 6/2009 Wang ..... H01S 5/50 343/754
8,058,714 B2 * 11/2011 Noll ..... H01Q 1/40 257/678
8,711,897 B2 * 4/2014 Miles ..... H01P 7/08 333/204
2002/0039083 A1 4/2002 Taylor et al.
2004/0041741 A1 * 3/2004 Hayes ..... H01Q 3/242 343/909
2011/0025565 A1 2/2011 Anderson
2014/0335695 A1 * 11/2014 Luere ..... H01L 21/67115 438/709
2015/0011027 A1 * 1/2015 Lian ..... H01L 22/12 438/16
2015/0212127 A1 * 7/2015 Ikeda ..... H05H 1/46 324/638
2015/0214621 A1 * 7/2015 Kim ..... H01Q 1/366 343/701

* cited by examiner

*Primary Examiner* — Trinh Dinh
(74) *Attorney, Agent, or Firm* — NSIP Law

(57) ABSTRACT

Provided is a plasma antenna. The plasma antenna includes a radiation portion formed by stacking a plurality of radiation disks generating plasma based on provided energy and radiating a signal using the generated plasma, an energy generation portion configured to provide the energy to at least one of the plurality of radiation disks, and a signal transmission portion configured to provide the signal to the at least one radiation disk provided with the energy. Therefore, it is possible to support multiple frequency bands.

8 Claims, 3 Drawing Sheets

PLASMA ANTENNA

CLAIM FOR PRIORITY

This application claims priority to Korean Patent Application No. 2014-0008783 filed on Jan. 24, 2014 in the Korean Intellectual Property Office (KIPO), the entire contents of which are hereby incorporated by reference.

BACKGROUND

1. Technical Field

Example embodiments of the present invention relate in general to a plasma antenna, and more particularly, to a plasma antenna which transmits a signal using plasma.

2. Related Art

An existing low-cost directive antenna has an end-fire array, dish, or horn structure for acquiring a desired beam direction and beam shape. The beam direction of an antenna is determined by the physical direction of the antenna, and the beam shape and the available frequency of the antenna are determined by the physical size and shape of a dish or a horn.

When a low-cost directive antenna is used, it is very difficult to operate the antenna at multiple frequencies while acquiring a beam shape. An array antenna generally occupies a large area, thus requiring the addition of an array to operate at multiple frequencies. A dish or horn antenna can operate at multiple frequencies using several antennas of different shapes. However, this causes interference in signal transmission between the antennas, and thus a beam width is limited.

SUMMARY

Accordingly, example embodiments of the present invention are proposed to substantially obviate one or more problems of the related art as described above, and provide a plasma antenna which supports multiple frequency bands and whose beam direction can be controlled with freedom.

Other purposes and advantages of the present invention can be understood through the following description, and will become more apparent through example embodiments of the present invention. Also, it is to be understood that purposes and advantages of the present invention can be easily achieved by means disclosed in claims and combinations of them.

In some example embodiments, a plasma antenna includes: a radiation portion formed by stacking a plurality of radiation disks generating plasma based on provided energy and radiating a signal using the generated plasma; an energy generation portion configured to provide the energy to at least one of the plurality of radiation disks; and a signal transmission portion configured to provide the signal to the at least one radiation disk provided with the energy. At least one of the plurality of radiation disks has a different size from other radiation disks.

Here, each of the radiation disks may include: a first surface having a conductive area; a second surface disposed to face the first surface and having a conductive area; and at least one plasma feed interposed between the first surface and the second surface and configured to transition to a plasma state with the provided energy.

Here, the plasma feed may be disposed in a circular shape with respect to a central axis of the radiation disk.

Here, the energy generation portion may provide current to the at least one of the plurality of radiation disks as the energy.

Here, the plurality of radiation disks may have disk shapes.

Here, when there are radiation disks having an identical diameter among the plurality of radiation disks, the radiation disks having the identical diameter may be stacked adjacent to each other.

Here, the energy generation portion may provide the energy to at least two of the radiation disks having the identical diameter.

Here, the plurality of radiation disks may have an identical height.

Here, at least one of the plurality of radiation disks may have a different height from other radiation disks.

Here, the energy generation portion may provide the energy to a radiation disk radiating the signal of a requested intensity among a plurality of the radiation disks having different heights.

Here, the plurality of radiation disks may be parallel to each other.

Here, at least one of the plurality of radiation disks may have a different diameter from other radiation disks.

Here, the plurality of radiation disks may be stacked in order of diameter.

Here, the energy generation portion may provide the energy to a radiation disk radiating the signal of a requested frequency band among a plurality of the radiation disks having different diameters.

BRIEF DESCRIPTION OF DRAWINGS

Example embodiments of the present invention will become more apparent by describing in detail example embodiments of the present invention with reference to the accompanying drawings, in which.

DESCRIPTION OF EXAMPLE EMBODIMENTS OF THE PRESENT INVENTION

Figure 1:
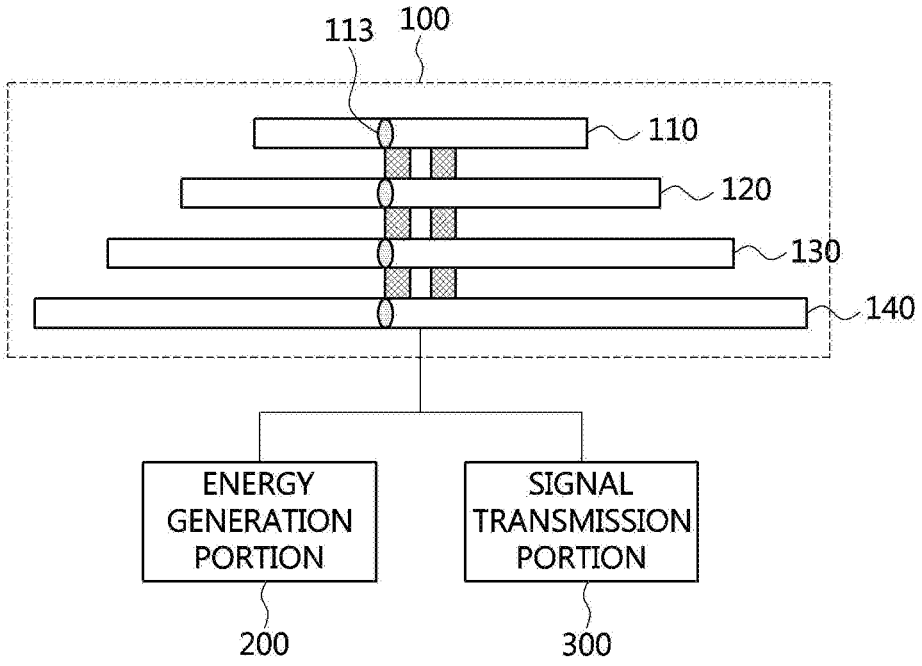
FIG. 1 is a conceptual diagram of a plasma antenna according to an example embodiment of the present invention.

Example embodiments of the present invention are described below in sufficient detail to enable those of ordinary skill in the art to embody and practice the present invention. It is important to understand that the present invention may be embodied in many alternate forms and should not be construed as limited to the example embodiments set forth herein.

Accordingly, while the invention can be modified in various ways and take on various alternative forms, specific embodiments thereof are shown in the drawings and described in detail below as examples. There is no intent to limit the invention to the particular forms disclosed. On the contrary, the invention is to cover all modifications, equivalents, and alternatives falling within the spirit and scope of the appended claims.

It will be understood that, although the terms "first," "second," "A," "B," etc. may be used herein in reference to elements of the invention, such elements should not be construed as limited by these terms. For example, a first element could be termed a second element, and a second element could be termed a first element, without departing from the scope of the present invention. Herein, the term "and/or" includes any and all combinations of one or more referents.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements. Other words used to describe relationships between elements should be interpreted in a like fashion (i.e., "between" versus "directly between," "adjacent" versus "directly adjacent," etc.). It will be understood that the term "connect" does not only denote a physical connection of an element stated herein but also denotes an electrical connection, a network connection, and so on.

The terminology used herein to describe embodiments of the invention is not intended to limit the scope of the invention. The articles "a," "an," and "the" are singular in that they have a single referent, however the use of the singular form in the present document should not preclude the presence of more than one referent. In other words, elements of the invention referred to in the singular may number one or more, unless the context clearly indicates otherwise. It will be further understood that the terms "comprises," "comprising," "includes," and/or "including," when used herein, specify the presence of stated features, numbers, steps, operations, elements, parts and/or combinations thereof, but do not preclude the presence or addition of one or more other features, numbers, steps, operations, elements, parts, and/or combinations thereof.

Unless otherwise defined, all terms (including technical and scientific terms) used herein are to be interpreted as is customary in the art to which this invention belongs. It will be further understood that terms in common usage should also be interpreted as is customary in the relevant art and not in an idealized or overly formal sense unless expressly so defined herein.

Hereinafter, example embodiments of the present invention will be described in detail with reference to the accompanying drawings. To facilitate general understanding of the present invention, like numbers refer to like elements throughout the description of the drawings, and the description of the same component will not be reiterated.

FIG. 1 is a conceptual diagram of a plasma antenna according to an example embodiment of the present invention.

Referring to FIG. 1, a plasma antenna includes a radiation portion 100, an energy generation portion 200, and a signal transmission portion 300.

The radiation portion 100 may include a plurality of radiation disks 110, 120, 130, and 140, which may be formed in a stack. Each of the radiation disks 110 to 140 may generate plasma based on provided energy, and may radiate a signal using the generated plasma.

The energy generation portion 200 may provide energy to at least one of the plurality of radiation disks 110 to 140. The provided energy may cause a plasma feed included in each radiation disk to transition to a plasma state. Here, the energy may denote heat, current, electromagnetic radiation, and so on.

The signal transmission portion 300 may provide the signal to the radiation disks 110 to 140 provided with the energy (i.e., radiation disks having transitioned to the plasma state) by the energy generation portion 200. The provided signal may be radiated by the radiation disks 110 to 140 and transmitted to a receiving end.

Figure 2:
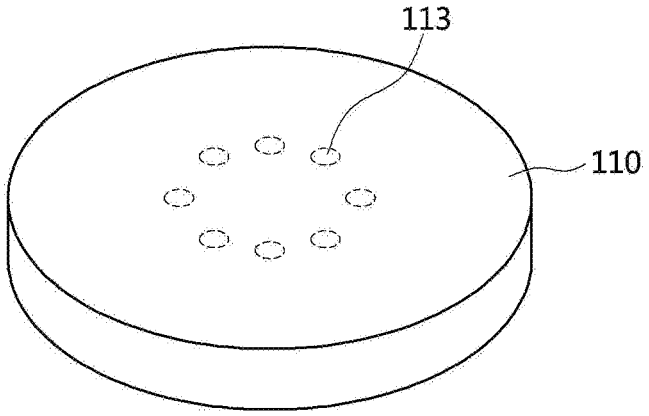
FIG. 2 is a perspective view of a radiation disk of the plasma antenna.
Figure 3:
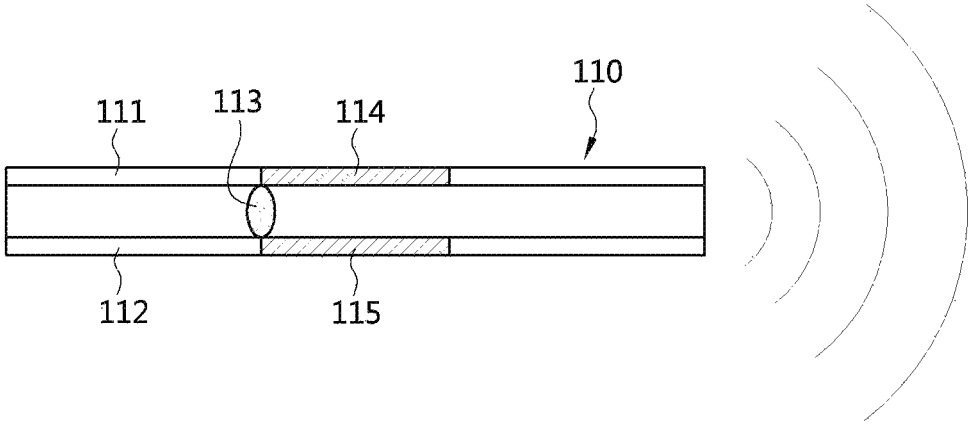
FIG. 3 is a cross-sectional view of the radiation disk of the plasma antenna.

FIG. 2 is a perspective view of a radiation disk of the plasma antenna, and FIG. 3 is a cross-sectional view of the radiation disk of the plasma antenna.

Referring to FIGS. 2 and 3, the radiation disk 110 may have a disk shape. The radiation disk 110 may include a first surface 111, a second surface 112, and at least one plasma feed 113. Although it is described that the radiation disk 110 has a disk shape, the shape of the radiation disk 110 is not limited to the disk shape and may be any of various shapes.

The first surface 111 may include a conductive area 114. The second surface 112 may be disposed to face the first surface 111, and may include a conductive area 115. When the first surface 111 denotes the upper surface of the radiation disk 110, the second surface 112 denotes the lower surface of the radiation disk 110. On the other hand, when the first surface 111 denotes the lower surface of the radiation disk 110, the second surface 112 denotes the upper surface of the radiation disk 110.

The plasma feed 113 may be interposed between the first surface 111 and the second surface 112. The plasma feed 113 may transition to the plasma state with energy (e.g., heat, current, and electromagnetic radiation) provided by the energy generation portion 200. A signal provided by the signal transmission portion 300 may be propagated into the radiation disk 110 by the plasma feed 113 and then reflected by a plasma reflector constituted of a plasma array or consecutive plasma areas, and the reflected signal may be radiated to the side of the radiation disk 110. Here, the plasma reflector may be disposed in the radiation disk 110, and may concentrate the signal propagated by the plasma feed 113 and send the signal to a desired destination. Also, similarly to the plasma feed 113, the plasma reflector may transition to the plasma state with the provided energy, and may reflect the signal in the plasma state.

In other words, the plasma feed 113 denotes a means for generating plasma, and a known plasma generation means may be used as the plasma feed 113.

When one plasma feed 113 is in the radiation disk 110, the plasma feed 113 may be disposed at the central axis of the radiation disk 110 or in an area a predetermined distance away from the central axis.

When a plurality of plasma feeds 113 are in the radiation disk 110, the plurality of plasma feeds 113 may be disposed in a circular shape with respect to the central axis of the radiation disk 110. Although it is described that the plurality of plasma feeds 113 are disposed in a circular shape, a shape in which the plurality of plasma feeds 113 are disposed is not limited to the circular shape, and the plurality of plasma feeds 113 may be disposed in various shapes in the radiation disk 110.

Referring back to FIG. 1, the plurality of radiation disks 110 to 140 included in the radiation portion 100 may have a disk shape. The plurality of radiation disks 110 to 140 may have an identical height and different diameters. In this case, the plurality of radiation disks 110 to 140 may be stacked in the radiation portion 100 in order of diameter. Also, the plurality of radiation disks 110 to 140 may be stacked in parallel with each other.

For example, when the diameters of the plurality of radiation disks 110 to 140 are as shown in Table 1 below, the fourth radiation disk 140 may be disposed at the bottom, the third radiation disk 130 may be disposed above the fourth radiation disk 140, the second radiation disk 120 may be disposed above the third radiation disk 130, and the first radiation disk 110 may be disposed above the second radiation disk 120.

TABLE 1

| Diameters of radiation disks |
|---|
| Fourth radiation disk 140 |
| > |
| Third radiation disk 130 |
| > |
| Second radiation disk 120 |
| > |
| First radiation disk 110 |

Alternatively, when the diameters of the plurality of radiation disks 110 to 140 are as shown in Table 1 above, the first radiation disk 110 may be disposed at the bottom, the second radiation disk 120 may be disposed above the first radiation disk 110, the third radiation disk 130 may be disposed above the second radiation disk 120, and the fourth radiation disk 140 may be disposed above the third radiation disk 130.

Although it is described that the plurality of radiation disks 110 to 140 are stacked in order of diameter, the radiation disks 110 to 140 may be stacked not only in this way but also in various other ways.

Among the plurality of radiation disks 110 to 140 stacked in order of diameter, neighboring radiation disks may be disposed at identical intervals. Each of the radiation disks 110 to 140 may be connected to the energy generation portion 200 and the signal transmission portion 300, may transition to the plasma state with energy provided by the energy generation portion 200, and may radiate a signal provided by the signal transmission portion 300.

The plurality of radiation disks 110 to 140 may support different frequency bands according to diameters. In other words, the larger the diameter of a radiation disk, the lower a supportable frequency band, and the smaller the diameter of a radiation disk, the higher a supportable frequency band.

For example, when the diameters of the plurality of radiation disks 110 to 140 are as shown in Table 1 above, the first radiation disk 110 may support the highest frequency band, the second radiation disk 120 may support a next highest frequency band to that of the first radiation disk 110, the third radiation disk 130 may support a next highest frequency band to that of the second radiation disk 120, and the fourth radiation disk 140 may support a next highest frequency band to that of the third radiation disk 130.

It is assumed below that the first radiation disk 110 supports a 5 GHz band, the second radiation disk 120 supports a 4 GHz band, the third radiation disk 130 supports a 3 GHz band, and the fourth radiation disk 140 supports a 2 GHz band.

When a signal is intended to be transmitted in the 5 GHz band, the energy generation portion 200 may provide energy to the first radiation disk 110, and then a plasma feed included in the first radiation disk 110 transitions to the plasma state. Subsequently, the signal transmission portion 300 may provide a signal to the first radiation disk 110. The signal provided to the first radiation disk 110 is reflected by the plasma feed and thus is radiated through the first radiation disk 110.

When a signal is intended to be transmitted in the 4 GHz band, the signal may be transmitted using the second radiation disk 120 similarly to the above case. In other words, the energy generation portion 200 may provide energy to the second radiation disk 120, and the signal transmission portion 300 may provide the signal to the second radiation disk 120.

When a signal is intended to be transmitted in the 3 GHz band, the signal may be transmitted using the third radiation disk 130 similarly to the above case. In other words, the energy generation portion 200 may provide energy to the third radiation disk 130, and the signal transmission portion 300 may provide the signal to the third radiation disk 130.

When a signal is intended to be transmitted in the 2 GHz band, the signal may be transmitted using the fourth radiation disk 140 similarly to the above case. In other words, the energy generation portion 200 may provide energy to the fourth radiation disk 140, and the signal transmission portion 300 may provide the signal to the fourth radiation disk 140.

As described above, the plasma antenna including the plurality of radiation disks 110 to 140 having different diameters may support multiple frequency bands.

Figure 4:
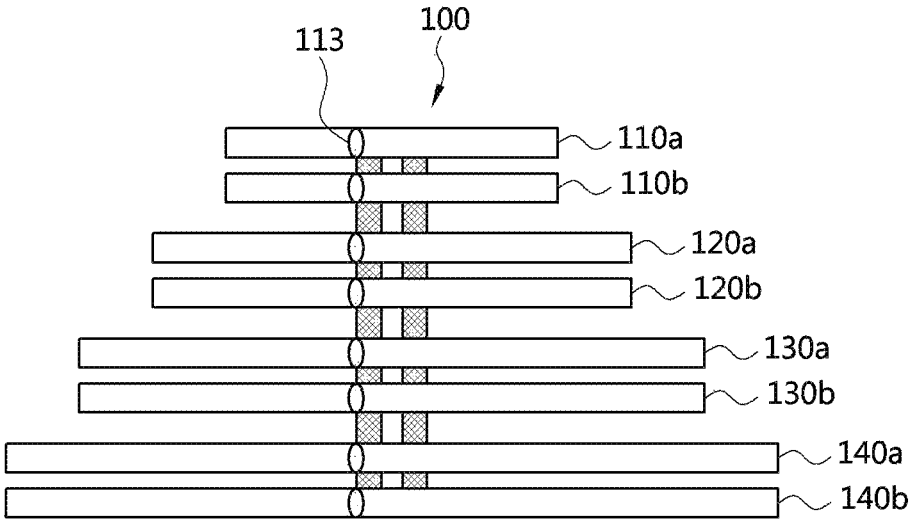
FIG. 4 is a cross-sectional view of an example embodiment of a stacked structure of radiation disks.

FIG. 4 is a cross-sectional view of an example embodiment of a stacked structure of radiation disks.

Referring to FIG. 4, the radiation portion 100 may include a plurality of radiation disks 110*a*, 110, 120*a*, 120*b*, 130*a*, 130*b*, 140*a*, and 140*b*, each of which may have a disk shape.

The first radiation disk 110*a* and the second radiation disk 110*b* have an identical diameter and height. The third radiation disk 120*a* and the fourth radiation disk 120*b* have an identical diameter and height. The fifth radiation disk 130*a* and the sixth radiation disk 130*b* have an identical diameter and height. The seventh radiation disk 140*a* and the eighth radiation disk 140*b* have an identical diameter and height.

When there are radiation disks having different diameters among the plurality of radiation disks 110*a*, 110*b*, 120*a*, 120*b*, 130*a*, 130*b*, 140*a*, and 140*b*, the plurality of radiation disks 110*a*, 110*b*, 120*a*, 120*b*, 130*a*, 130*b*, 140*a*, and 140*b* may be stacked in order of diameter. When there are radiation disks having an identical diameter among the plurality of radiation disks 110*a*, 110*b*, 120*a*, 120*b*, 130*a*, 130*b*, 140*a*, and 140*b*, the radiation disks having the identical diameter may be stacked adjacent to each other. Also, the plurality of radiation disks 110*a*, 110*b*, 120*a*, 120*b*, 130*a*, 130*b*, 140*a*, and 140*b* may be stacked in parallel with each other.

For example, when the diameters of the plurality of radiation disks 110*a*, 110*b*, 120*a*, 120*b*, 130*a*, 130*b*, 140*a*, and 140*b* are as shown in Table 2 below, the seventh radiation disk 140*a* and the eighth radiation disk 140*b* may be disposed at the bottom, the fifth radiation disk 130*a* and the sixth radiation disk 130*b* may be disposed above the seventh radiation disk 140*a* and the eighth radiation disk 140*b*, the third radiation disk 120*a* and the fourth radiation disk 120*b* may be disposed above the fifth radiation disk 130*a* and the sixth radiation disk 130*b*, and the first radiation disk 110*a* and the second radiation disk 110*b* may be disposed above the third radiation disk 120*a* and the fourth radiation disk 120*b*.

TABLE 2

| Diameters of radiation disks |
|---|
| Seventh radiation disk 140a = eighth radiation disk 140b |
| > |
| Fifth radiation disk 130a = sixth radiation disk 130b |
| > |
| Third radiation disk 120a = fourth radiation disk 120b |
| > |
| First radiation disk 110a = second radiation disk 110b |

Although it is described that the plurality of radiation disks 110*a*, 110*b*, 120*a*, 120*b*, 130*a*, 130*b*, 140*a*, and 140*b* are stacked in order of diameter, the radiation disks 110*a*, 110*b*, 120*a*, 120*b*, 130*a*, 130*b*, 140*a*, and 140*b* may be stacked not only in this way but also in various other ways.

Each of the radiation disks 110*a*, 110*b*, 120*a*, 120*b*, 130*a*, 130*b*, 140*a*, and 140*b* may be connected to the energy generation portion 200 and the signal transmission portion 300, may transition to the plasma state with energy provided by the energy generation portion 200, and may radiate a signal provided by the signal transmission portion 300.

The plurality of radiation disks 110*a*, 110*b*, 120*a*, 120*b*, 130*a*, 130*b*, 140*a*, and 140*b* may support different frequency bands according to diameters. In other words, the larger the diameter of a radiation disk, the lower a supportable frequency band, and the smaller the diameter of a radiation disk, the higher a supportable frequency band.

Meanwhile, the intensity of a signal varies according to the number of radiation disks used to transmit the signal, and thus the number of radiation disks may be adjusted based on a required signal intensity. In other words, the greater the number of radiation disks used to transmit a signal (i.e., radiation disks having an identical diameter), the greater the intensity of the signal.

For example, if it is determined that the intensity of a signal is weak when only the first radiation disk 110*a* is used to transmit the signal, the first radiation disk 110*a* and the second radiation disk 110*b* may be used together to transmit a signal. In other words, the energy generation portion 200 may provide energy to the first radiation disk 110*a* and the second radiation disk 110*b*, and the signal transmission portion 300 may provide a signal to the first radiation disk 110*a* and the second radiation disk 110*b*. In this way, by increasing the number of radiation disks used to transmit a signal, it is possible to increase the intensity of the signal.

When the third radiation disk 120*a*, the fifth radiation disk 130*a*, and the seventh radiation disk 140*a* are used, it is also possible to increase the intensity of a signal by increasing the number of radiation disks used to transmit the signal (i.e., radiation disks having an identical diameter), like in the above description.

Figure 5:
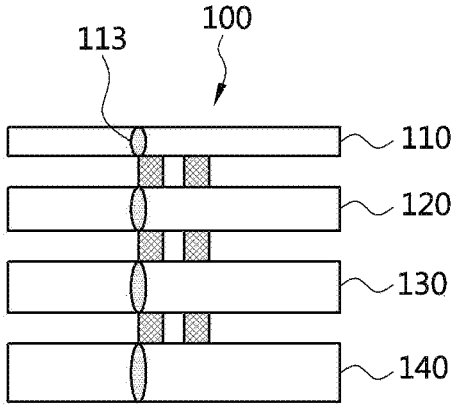
FIG. 5 is a cross-sectional view of another example embodiment of a stacked structure of radiation disks.

FIG. 5 is a cross-sectional view of another example embodiment of a stacked structure of radiation disks.

Referring to FIG. 5, the radiation portion 100 may include a plurality of radiation disks 110, 120, 130, and 140, which may be formed in a stack. The respective radiation disks 110 to 140 may have an identical diameter and different heights. Also, the plurality of radiation disks 110 to 140 may be stacked in parallel with each other.

For example, when the heights of the plurality of radiation disks 110 to 140 are as shown in Table 3 below, a signal transmitted through the fourth radiation disk 140 has the strongest intensity, a signal transmitted through the third radiation disk 130 has a next strongest intensity to that of the signal transmitted through the fourth radiation disk 140, a signal transmitted through the second radiation disk 120 has a next strongest intensity to that of the signal transmitted through the fourth radiation disk 130, and a signal transmitted through the first radiation disk 110 has a next strongest intensity to that of the signal transmitted through the second radiation disk 120.

TABLE 3

| Heights of radiation disks |
|---|
| Fourth radiation disk 140 |
| > |
| Third radiation disk 130 |
| > |
| Second radiation disk 120 |
| > |
| First radiation disk 110 |

When a plasma antenna having this structure is used, it is possible to transmit a signal using a radiation disk supporting a requested intensity of the signal. For example, when the first radiation disk 110 supports a requested intensity of a signal, the energy generation portion 200 may provide energy to the first radiation disk 110, and then the first radiation disk 110 may transition to the plasma state. Subsequently, the signal transmission portion 300 may transmit a signal to the first radiation disk 110, and the transmitted signal may be radiated by the radiation disk 110 which is in the plasma state.

Also, at least two of the radiation disks 110 to 140 may be used together to transmit a signal.

Figure 6:
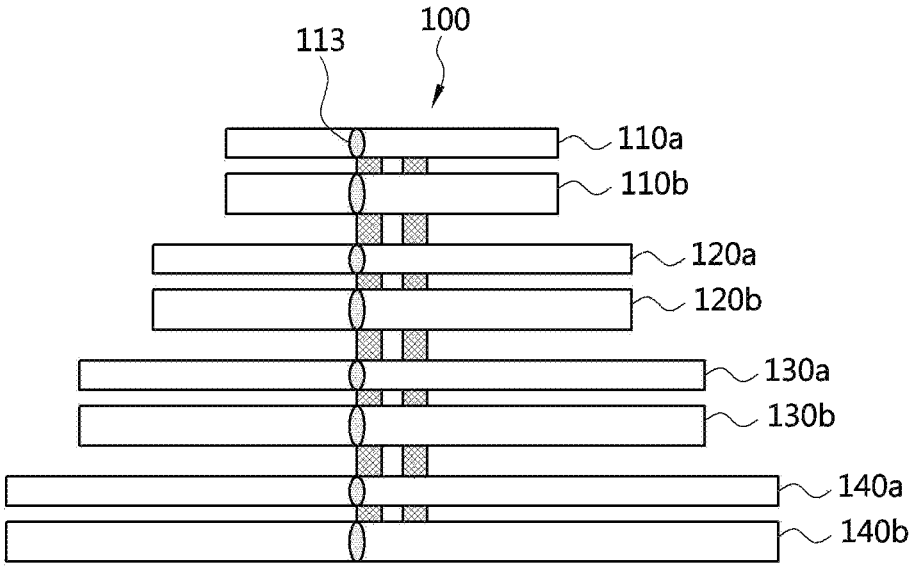
FIG. 6 is a cross-sectional view of still another example embodiment of a stacked structure of radiation disks.

FIG. 6 is a cross-sectional view of still another example embodiment of a stacked structure of radiation disks.

Referring to FIG. 6, the radiation portion 100 may include a plurality of radiation disks 110*a*, 110*b*, 120*a*, 120*b*, 130*a*, 130*b*, 140*a*, and 140*b*, each of which may have a disk shape.

The first radiation disk 110*a* and the second radiation disk 110*b* have an identical diameter and different heights. The third radiation disk 120*a* and the fourth radiation disk 120*b* have an identical diameter and different heights. The fifth radiation disk 130*a* and the sixth radiation disk 130*b* have an identical diameter and different heights. The seventh radiation disk 140*a* and the eighth radiation disk 140*b* have an identical diameter and different heights.

When there are radiation disks having different diameters among the plurality of radiation disks 110*a*, 110*b*, 120*a*, 120*b*, 130*a*, 130*b*, 140*a*, and 140*b*, the plurality of radiation disks 110*a*, 110*b*, 120*a*, 120*b*, 130*a*, 130*b*, 140*a*, and 140*b* may be stacked in order of diameter. When there are radiation disks having an identical diameter among the plurality of radiation disks 110*a*, 110*b*, 120*a*, 120*b*, 130*a*, 130*b*, 140*a*, and 140*b*, the radiation disks having the identical diameter may be stacked adjacent to each other. Also, the plurality of radiation disks 110*a*, 110*b*, 120*a*, 120*b*, 130*a*, 130*b*, 140*a*, and 140*b* may be stacked in parallel with each other.

For example, when the diameters of the plurality of radiation disks 110*a*, 110*b*, 120*a*, 120*b*, 130*a*, 130*b*, 140*a*, and 140*b* are as shown in Table 2 above, the seventh radiation disk 140*a* and the eighth radiation disk 140*b* may be disposed at the bottom, the fifth radiation disk 130*a* and the sixth radiation disk 130*b* may be disposed above the seventh radiation disk 140*a* and the eighth radiation disk 140*b*, the third radiation disk 120*a* and the fourth radiation disk 120*b* may be disposed above the fifth radiation disk 130*a* and the sixth radiation disk 130*b*, and the first radiation disk 110*a* and the second radiation disk 110*b* may be disposed above the third radiation disk 120*a* and the fourth radiation disk 120*b*.

Each of the radiation disks 110*a*, 110*b*, 120*a*, 120*b*, 130*a*, 130*b*, 140*a*, and 140*b* may be connected to the energy generation portion 200 and the signal transmission portion 300, may transition to the plasma state with energy provided by the energy generation portion 200, and may radiate a signal provided by the signal transmission portion 300.

A frequency band varies according to the diameter of a radiation disk. Therefore, it is possible to select a radiation disk supporting a requested frequency band from among the plurality of radiation disks 110*a*, 110*b*, 120*a*, 120*b*, 130*a*, 130*b*, 140*a*, and 140*b*, and transmit a signal through the selected radiation disk. In other words, the energy generation portion 200 may provide energy to the selected radiation disk, and the signal transmission portion 300 may provide a signal to the selected radiation disk.

A signal intensity varies according to the height of a radiation disk. Therefore, it is possible to select a radiation disk supporting a requested intensity of a signal from among the plurality of radiation disks 110*a*, 110*b*, 120*a*, 120*b*, 130*a*, 130*b*, 140*a*, and 140*b*, and transmit the signal through the selected radiation disk. In other words, the energy generation portion 200 may provide energy to the selected radiation disk, and the signal transmission portion 300 may provide a signal to the selected radiation disk.

According to example embodiments of the present invention, it is possible to support multiple frequency bands using a plasma antenna in which radiation disks having different sizes are stacked.

While the example embodiments of the present invention and their advantages have been described in detail, it should be understood that various changes, substitutions and alterations may be made herein without departing from the scope of the invention.

What is claimed is:

1. A plasma antenna, comprising:

a first disk pair comprising a first disk and a second disk;

a second disk pair disposed under the first disk pair and comprising a third disk and a fourth disk;

an energy generator configured to provide energy to at least one of the first to fourth disks;

a signal transmitter configured to transmit a signal to the at least one of the first to fourth disks; and at least one plasma feed interposed between a first surface and a second surface of each of the first to fourth disks, wherein the first surface comprises a first conductive area, and the second surface faces the first surface and comprises a second conductive area, and wherein the first disk and the second disk comprise an identical diameter, the third disk and the fourth disk comprise an identical diameter, the first disk and the third disk comprise a different diameter, the first disk and the second disk comprise a different height, and the third disk and the fourth disk comprise a different height.

2. The plasma antenna of claim 1, wherein the at least one plasma feed comprises a circular cross section.

3. The plasma antenna of claim 1, wherein the energy generator is further configured to provide the energy to the first disk pair and the second disk pair.

4. The plasma antenna of claim 1, wherein the energy generator is further configured to provide the energy to a disk of the first to fourth disks based on an expected radiation intensity to be emitted from the disk.

5. The plasma antenna of claim 1, wherein the first to fourth disks are arranged parallel to each other.

6. The plasma antenna of claim 1, wherein the first to fourth disks are arranged in order of diameter.

7. The plasma antenna of claim 1, wherein the energy generator is further configured to provide the energy to at least one of the first to fourth disks based on an expected frequency band of radiation to be emitted from the disk.

8. The antenna of claim 1, wherein each of the first to fourth disks contains plasma.

* * * * *